US005855107A

United States Patent [19]

Haffield

[11] Patent Number: 5,855,107

[45] Date of Patent: Jan. 5, 1999

[54] METHOD AND APPARATUS FOR PACKAGING AGRICULTURAL PLANT MATERIAL

[76] Inventor: John Haffield, Gower Villas, Clynderwen, Dyfed SA66 7NL, United Kingdom

[21] Appl. No.: 446,759

[22] PCT Filed: Nov. 25, 1993

[86] PCT No.: PCT/GB93/02434

§ 371 Date: Oct. 27, 1995

§ 102(e) Date: Oct. 27, 1995

[87] PCT Pub. No.: WO94/12394

PCT Pub. Date: Jun. 9, 1994

[30] Foreign Application Priority Data

Nov. 26, 1992 [GB] United Kingdom ..... 9224766

[51] Int. Cl.[6] ..... B65B 9/15; B65B 9/18; B65B 25/02

[52] U.S. Cl. ..... 53/567; 53/548; 53/550

[58] Field of Search ..... 53/459, 467, 576, 53/450, 451, 550, 551, 548

[56] References Cited

U.S. PATENT DOCUMENTS

| | | | |
|---|---|---|---|
| 2,656,658 | 10/1953 | Grady | 53/576 |
| 3,726,060 | 4/1973 | McMillan | 53/576 X |
| 3,763,621 | 10/1973 | Klein et al. | 53/576 X |
| 3,940,906 | 3/1976 | Leckband et al. | 53/576 X |
| 4,606,176 | 8/1986 | Cundall | 53/567 |
| 4,888,937 | 12/1989 | Glenn | 53/567 |
| 4,938,006 | 7/1990 | Korsgaard | 53/567 X |
| 5,009,058 | 4/1991 | Ptaschek et al. | 53/469 |
| 5,335,479 | 8/1994 | Lemke et al. | 53/551 X |
| 5,367,857 | 11/1994 | Carlson | 53/459 X |
| 5,408,810 | 4/1995 | Cullen | 53/567 |

FOREIGN PATENT DOCUMENTS

| | | |
|---|---|---|
| 0302460 | 2/1989 | European Pat. Off. . |
| 2165543 | 8/1973 | France . |
| 2239880 | 2/1974 | Germany . |
| 2450876 | 5/1976 | Germany . |

*Primary Examiner*—Horace M. Culver
*Attorney, Agent, or Firm*—Edwin D. Schindler

[57] ABSTRACT

A bale of cut silage 2 is fed into a sheath 8 of flexible packaging. Apparatus 1 comprises thermal sealing/cutting heads 14,15 and intermediate blades 20. Heads 14,15 seal a rear end 21 of package 22; blades 20 separate package 22 from the remainder of sheath 8; heads 14,15 provide a further sealed end 9 for sheath 8 ready to receive the next bale 2 to be packaged.

15 Claims, 3 Drawing Sheets

METHOD AND APPARATUS FOR PACKAGING AGRICULTURAL PLANT MATERIAL

The present invention relates to a method and apparatus suitable for packaging agricultural plaint material, and in particular to such a method and apparatus for packaging animal fodder such as silage or the like.

Typically, agricultural plant material, such as silage, is packaged for storage, in bale form, by wrapping a plastics sheet around the bale and securing in place. Usually, the plastics sheet is precut to a predetermined size and shape dependent on the size and shape of the bales to be packaged. Using known techniques it is difficult to produce a silage bale wrapper machine which may be used for wrapping both cylindrical and rectanglar (or square) bales. Furthermore, the procedure for wrapping individual bales is both complicated and time consuming.

I have now devised an improved method and apparatus for packaging agricultural plant material which alleviates some of the aforementioned difficulties.

According to a first aspect of the invention, there is provided a method of packaging agricultural plant material, which method comprises feeding a quantity of said agricultural plant material into a sheath of flexible packaging material susceptible to thermal bonding (such as a plastics sheet material) and subsequently:

a) thermally sealing a first portion of the sheath to form a discrete package for the abovementioned quantity of plant material;

b) separating the portion of the sheath comprising the discrete package from the remainder of the sheath: and c) thermally sealing a second portion of the sheath to provide an effectively closed end for the remainder of the sheath.

It is preferred that the end of the sheath into which the plant material is initially fed is effectively closed prior to introduction of the plant material into the sheath.

Typically, the plant material is fed into the sheath in discrete quantities, such as bales, although it is envisaged that the plant material may, in certain circumstances be continuously fed into the sheath.

Advantageously, the feeding of the plant material into said sheath causes a length of the sheath to be pulled (or wrapped) over the plant material.

Typically, the sheath will be generally tubular, and it is preferred that a predetermined length of the sheet material is pulled over the quantity of plant material prior to steps a,b and c referred to above being effected. The tubular sheath may be of circular section, although in some embodiments, the tubular sheath may be of square or rectangular section or the like.

The use of thermal sealing, is particularly advantageous in allowing, at least two, and preferably all three, of steps a,b and c referred to above, to be carried out in a single operation. Thermal sealing is beneficial in optimising the efficiency of the process, and apparatus as hereinafter described, both in terms of speed and the reliability of the resulting seals.

Advantageously, the operation of steps a,b and c referred to above is controlled by control means actuable when a selected length of the sheath has been pulled over the quantity of plant material; such control means may include one or more stop member arranged to ensure initiation of one or more of the thermal sealing steps.

Advantageously, the sheath material will be dispensed from a store of sheath material under the action of force exerted on the effectively closed end of the sheath by the quantity of plant material being fed into the sheath.

According to a second aspect of the invention, there is provided apparatus for packaging agricultural plant material, which apparatus comprises:

a) a dispenser of elongate flexible material susceptible to thermal bonding, which flexible material is arranged to define a sheath into which the plant material can be fed;

b) first thermal sealing means arranged to seal first portions of the sheath together at a first position;

c) second thermal sealing means arranged to seal second portions of the sheath together at a second position spaced from the first position; and d) separating means arranged to separate adjacent portions of the sheath at a position intermediate between the first and second positions.

Advantageously the dispenser includes housing means arranged to contain a dispensable length of the sheath material, which housing further defines an aperture through which agricultural plant material can be fed.

Typically, the sheath will be generally tubular, and stored in concertina or roll form in the housing.

It is preferred that the housing is provided with a continuous slit or slot through which said flexible sheath can be dispensed.

The housing is preferably annular in configuration thereby defining a substantially circular aperture therethrough.

Advantageously, the sheath is provided with an effectively closed end such that the sheath acts as a pouch into which the plant material may be fed.

It is preferred that the first and second scaling means and the separating means act on the sheath at a position to the rear of a quantity of plant material being packaged. Advantageously, the first scaling means is arranged to provide an effectively sealed (or closed) termination (or end) to a preceding package of plant material, with the second scaling means arranged to produce an effectively sealed (or closed) termination (or end) to a following package. The separating means separates the preceding package from the following package.

Advantageously, the first and second sealing means, and also preferably the separating means, are actuable in a single operation thereby effecting sealing and separation in a single operation.

It is preferred that feeding means is provided arranged to feed the plant material into the sheath. Typically, the feeding means comprises a conveyor or the like, which is typically spiked.

Advantageously, the sheath dispenser will be mounted on support means, which typically comprises a support platform advantageously inclined at an angle to the horizontal such that the plant material passes into the sheath under the influence of gravity. Alternatively, the plant material may be forced through mechanically (for example, by means of a hydraulically operated mechanism or the like). Typically the support platform will be provided with support rollers, conveyors or the like over which the packaged plant material may pass.

Advantageously, the separating means comprises at least one blade element, heated wire or the like.

In a preferred embodiment of the invention, the first and second scaling means comprise respective pairs of sealing elements which may be urged toward one another to effect scaling.

Advantageously at respective member of each pair of scaling elements is provided on a respective one of a pair of movable heads. Advantageously, at least one of the pair of movable heads is further provided with a blade element, heated wire or the like, typically positioned between the scaling elements.

It is preferred that the movable heads are movable under the influence of pneumatic or hydraulic cylinder/ram arrangements.

Typically, control means are provided to automatically control the operation of the movable heads. Advantageously, the control means comprise one or more position detectors arranged to be actuated when a selected length of the sheath has been dispensed.

The invention will now be further described in a specific embodiment by way of example only, and with reference to the accompanying drawings, in which.

Figure 1:
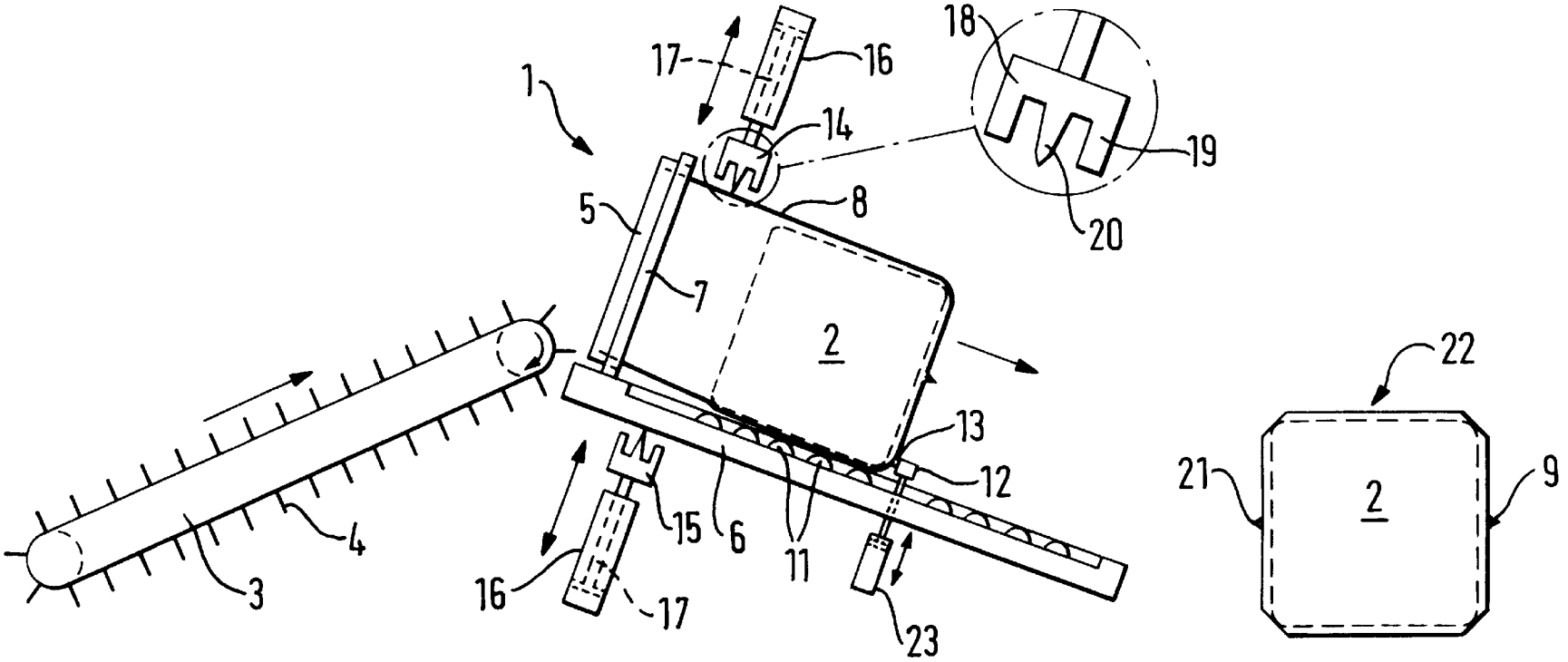
FIG. 1 is a schematic representation of apparatus according to the second aspect of the invention for use in the method according to the first aspect of the invention.

Referring to the drawings, and initially to FIG. 1 in particular, there is shown apparatus 1 shown for use in packaging harvested agricultural material (typically bales of cut silage 2).

The apparatus illustrated comprises an inclined conveyor 3 provided with spikes 4 onto which bales of cut silage are loaded. The conveyor 3 transports the bales 2 upwardly to the open mouth of a packaging cartridge 5 which is retained on an inclined support platform 6 by means of a retaining bracket 7. Alternative types of conveyors or lifting devices which may be used include hydraulic arms or the like.

Figure 2:
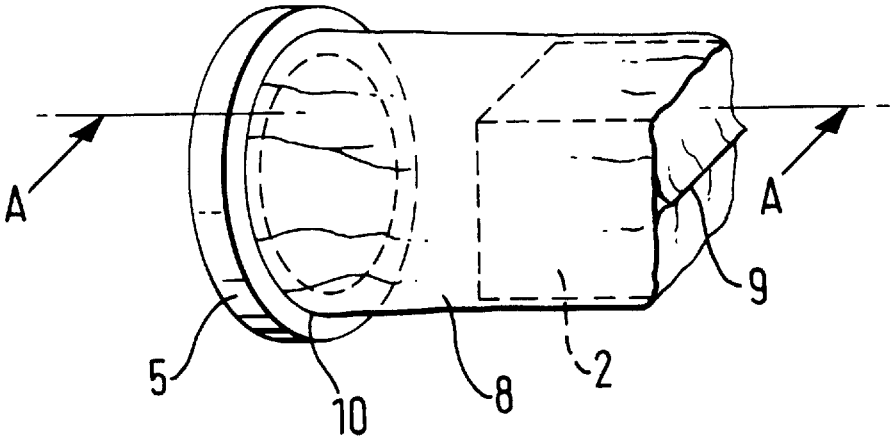
FIG. 2 is an explanatory perspective view of a part of the apparatus of FIG. 3 is a cross section along line A—A of FIG. 2.
Figure 3:
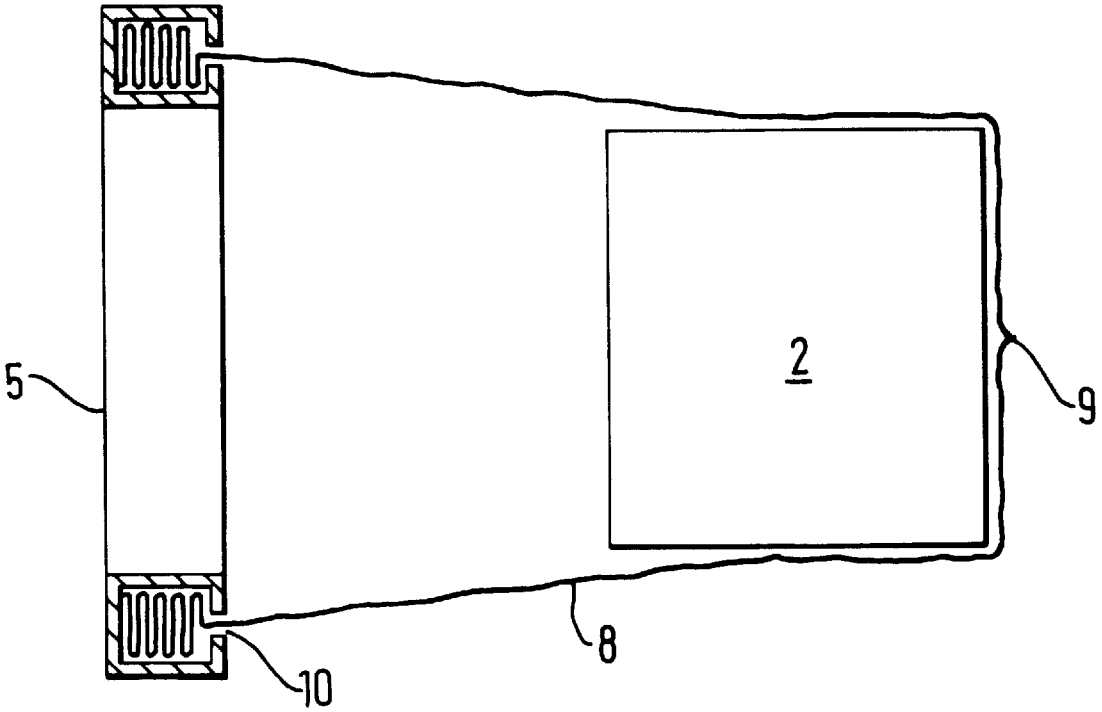

Referring to FIGS. 2 and 3, the packaging cartridge 5 comprises an annular housing containing a tubular sheath 8 of flexible sheet material (typically plastics sheet) which is closed (e.g. as illustrated along a seal line 9 by bonding).

The seat as shown is linear, although is it, of course, possible to provide a seal which is a closer approximation to a point seal.

The sheath 8 is stored in a rolled or concertina form in the housing and may be dispensed therefrom through, an annular slit 10 in the housing in the downstream direction of processing of the bale 2.

On reaching the top of the spiked conveyor 3, the bale 2 passes under the influence of gravity through the annular cartridge 5 and over rollers 11 (or other suitable feed system, such as a conveyor or the like) on inclined support platform 6 until is downward motion is checked by abutting stop 12. As the bale rolls over rollers 11 toward stop 12, the tubular sheath 8 is pulled out of cartridge 5 to provide a substantially complete covering for the bale 2.

When the bale 2 contacts stop 12, a limit switch 13 is actuated. Limit switch 13 forms part of an automatic control system for the apparatus which will be described in greater detail below. Actuation of switch 13 causes A pair of scaling/cutting heads 14/15 to be urged toward one another to the rear of bale 2, by means of hydraulic or pneumatic cylinder/ram arrangements 16/17. Movement of the sealing/cutting heads 14/15 toward one another causes a portion of sheath 9 to be wrapped around the rear of bale 2.

Each sealing/cutting head 14/15 comprises a pair of heating elements 18,19 arranged one either side of an intermediate blade element 20. As scaling/cutting heads 14/15 engage one another (with a double thickness of sheath 8 sandwiched therebetween), corresponding heating element 18 and 19 abut one another and are energised thereby causing correspondingly "sandwiched" portions of sheath 5 to be thermally bonded (sealed) together. At the same time, the action of corresponding blade elements 20 causes the portion of the sheath 8 intermediate the "sandwiched" portions to be served. In this way, the action of the sealing/cutting heads causes the package for the bale 2 to be completed and provided with a rear sealed end 21; separates the sealed package 22 from the reminder of the sheath 8; and provides a further sealed end 9 for the sheath ready to receive the next bale 2 to be packaged. The blade may, in some embodiments, be retractable; in other embodiments the cutting/scaling blade may both and seal in a single operation.

Subsequent to sealing and cutting, the heads 14,15 are retracted to their starting position, and stop 12 retracted by means of hydraulic or pneumatic cylinder/ram 23 enabling scaled package 22 to proceed under gravity over rollers 11 and be removed from the apparatus for transportation to a storage location.

Packaging cartridge 5 is demountable from the apparatus (specially from mounting bracket 7) and may be replaced when the stored supply of sheath 8 is exhausted.

Figure 4:
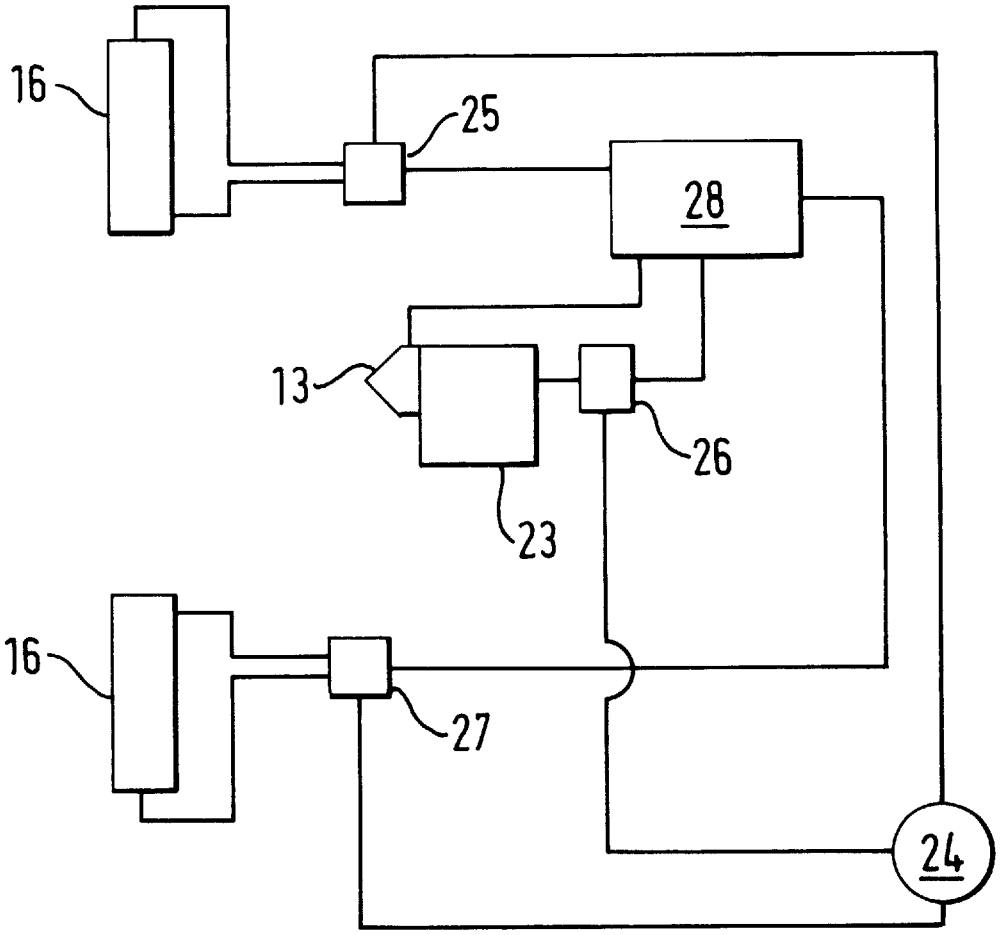
FIG. 4 is a schematic view of an automatic control system suitable for use with the apparatus of FIGS. 1 to 3.

Referring to FIG. 4, there is shown schematically the control system for operating the apparatus. Hydraulic rain 24 provides pressurised fluid to cylinders 16,23 via relevant ports of respective solenoid control valves 25,26,27. A programmable logic controller 28 (or other logic (device) controls the switching of valves 25,26,27 and is responsive to signal input from the limit switch 13 provided on stop ram 23. Alternatively, instead of the hydraulic system described and illustrated, a correspondingly operating pneumatic system may be employed.

I claim:

1. Apparatus for packaging agricultural bales, comprising:

(a) an annular housing mounted on a support platform comprising support rollers and conveyors for dispensing elongate flexible material defining a sheath into which said bale is able to be fed, said annular housing being inclined at an angle to the horizontal so that said bale passes into said sheath under gravity;

(b) first thermal sealing means being arranged for sealing first portions of said sheath together at a first position;

(c) second thermal sealing means being arranged for sealing second portions of said sheath together at a second position spaced from said first position, wherein said first thermal sealing means and said second thermal sealing means comprise respective pairs of sealing elements which are able to be urged toward one another for effecting sealing; and, (d) separating means being arranged for separating adjacent portions of said sheath at a position intermediate said first positions and said second positions.

2. The apparatus according to claim 1, wherein said housing has a continuous slit or slot through which said flexible sheath is dispensable.

3. The apparatus according to claim 1, wherein said housing defines an aperture through which said bale can be introduced.

4. The apparatus according to claim 1, wherein said first thermal sealing means, said second thermal sealing means and said separating means are arranged for acting on the sheath at a position to the rear of said bale being packaged.

5. The apparatus according to claim 1, wherein said first thermal sealing means is arranged for providing an effectively sealed termination to a preceding bale, with said second thermal sealing means being arranged for producing an effectively sealed termination to a subsequent bale.

6. The apparatus according to claim 5, wherein said first thermal sealing means, said second thermal sealing means and said separation means are actuable in a single operation thereby effecting sealing and separation in a single operation.

7. The apparatus according to claim 6, further comprising feeding means being arranged for introducing said bale into said sheath.

8. The apparatus according to claim 7, wherein said feeding means includes a conveyor.

9. The apparatus according to claim 1, wherein said separating means comprises at least one blade element.

10. The apparatus according to claim 1, wherein said separating means comprises at least one heated wire.

11. The apparatus according to claim 1, wherein a respective number of each pair of sealing elements has thereon a respective one of a pair of movable heads.

12. The apparatus according to claim 11, wherein at least one of the pair of movable heads has a blade element positioned between said sealing elements.

13. The apparatus according to claim 11, wherein at least one of the pair of movable heads has a heated wire positioned between said sealing elements.

14. The apparatus according to claim 11, further comprising control means for automatically controlling the operation of said movable heads.

15. The apparatus according to claim 14, wherein said control means comprises at least one position detector being arranged for being actuated when a selected length of said sheath has been dispensed.

* * * * *